US010762886B2

(12) United States Patent
Nakazawa

(10) Patent No.: US 10,762,886 B2
(45) Date of Patent: Sep. 1, 2020

(54) VIBRATION APPLYING APPARATUS

(71) Applicant: Synca-Outfit NQ co., Ltd., Tokyo (JP)

(72) Inventor: Hideta Nakazawa, Tokyo (JP)

(73) Assignee: SYNCA-OUTFIT NQ CO., LTD., Tokyo (JP)

( * ) Notice: Subject to any disclaimer, the term of this patent is extended or adjusted under 35 U.S.C. 154(b) by 0 days.

(21) Appl. No.: 16/531,633

(22) Filed: Aug. 5, 2019

(65) Prior Publication Data

US 2019/0392806 A1 Dec. 26, 2019

Related U.S. Application Data

(63) Continuation of application No. PCT/JP2019/009985, filed on Mar. 12, 2019.

(30) Foreign Application Priority Data

Jun. 26, 2018 (JP) ..... 2018-120474

(51) Int. Cl.

| | |
|---|---|
| ***G10H 3/22*** | (2006.01) |
| ***G10G 5/00*** | (2006.01) |
| ***G10D 3/22*** | (2020.01) |

(52) U.S. Cl.

CPC ..... *G10H 3/22* (2013.01); *G10D 3/22* (2020.02); *G10G 5/00* (2013.01)

(58) Field of Classification Search

CPC ..... G10H 3/22; G10D 3/22

See application file for complete search history.

(56) References Cited

U.S. PATENT DOCUMENTS

| | | | | |
|---|---|---|---|---|
| 5,031,501 | A * | 7/1991 | Ashworth | G10D 3/00 84/723 |
| 5,537,908 | A * | 7/1996 | Rabe | G10D 3/22 84/454 |
| 7,227,068 | B1 * | 6/2007 | Van Doren | G10D 3/22 84/297 R |
| 7,678,987 | B2 * | 3/2010 | Lye | G10D 3/22 84/723 |
| 7,977,555 | B2 * | 7/2011 | Hall | G10D 3/22 84/291 |
| 7,977,565 | B1 * | 7/2011 | Lye | G10D 3/00 84/723 |
| 8,134,064 | B2 * | 3/2012 | Sanns, Jr. | G10H 3/18 84/723 |
| 8,642,877 | B1 | 2/2014 | Blish | |
| 9,583,076 | B2 * | 2/2017 | Nigro | G10H 3/22 |

(Continued)

FOREIGN PATENT DOCUMENTS

JP 2006-65276 3/2006

OTHER PUBLICATIONS

English Translation of Office Action in Corresponding JP Application 2018-120474, dated Nov. 8, 2018.

(Continued)

*Primary Examiner* — Robert W Horn

(74) *Attorney, Agent, or Firm* — Ryan Alley IP

(57) ABSTRACT

A vibration applying apparatus includes a bone conduction speaker, a pedestal to which the bone conduction speaker is fixed, and supporting units on which a stringed instrument is placed, and is designed to transmit natural vibrations emanating from the bone conduction speaker to one of the supporting units via the pedestal.

4 Claims, 3 Drawing Sheets

(56) References Cited

U.S. PATENT DOCUMENTS

| | | | | |
|---|---|---|---|---|
| 10,121,457 | B2 * | 11/2018 | Gilbert | G10H 3/125 |
| 10,621,965 | B2 * | 4/2020 | Abiko | G10H 3/22 |
| 2009/0293707 | A1 * | 12/2009 | Suhr | G10D 3/22 84/723 |
| 2013/0047825 | A1 * | 2/2013 | Kernaghan | G10D 3/22 84/723 |
| 2019/0392806 | A1 * | 12/2019 | Nakazawa | G10G 5/00 |

OTHER PUBLICATIONS

Office Action in Corresponding JP Application 2018-120474, dated Nov. 8, 2018 (Translation already submitted).

* cited by examiner

VIBRATION APPLYING APPARATUS

CROSS-REFERENCE TO RELATED APPLICATION

This application is a continuation application of International Application PCT/JP2019/009985 filed on Apr. 26, 2019, designating the U.S. and claiming priority from Japanese Patent Application No. 2018-120474 filed on Jun. 26, 2018. The entire contents of both foregoing applications are incorporated herein by reference.

FIELD

The embodiment discussed herein relates to a vibration applying apparatus.

BACKGROUND

Aging devices for musical instruments made of wood have been known. For example, one of such devices is designed so that, in a structure that defines a box-shaped storage space and has a surrounding composite wall formed by sandwiching a thermal insulation filling material that has humidity buffering and sound insulation and absorption and that is cellulose insulation made from fiber and granular material or materials having equivalent properties thereto with air contained therein between an inner wall material having moisture permeability and a sound absorption coefficient that does not emphasize standing waves dependent on internal dimensions and an outer wall material that is a wood-based material with waterproof breathability and sound insulation or another material having equivalent properties thereto, and an openable and closeable door made of a wall material having equivalent properties to the composite wall, this device has a heater that keeps the temperature of the interior space higher than the outside, and plays music using an acoustic apparatus in the interior space to apply acoustic excitation while a wooden musical instrument, an object or product made of a natural plant or animal material, or the like is placed in the interior space.

Please see, for example, Japanese Laid-open Patent Publication No. 2011-22546.

Historical Overview of Violins

It is a well-known fact that many violins and other stringed musical instruments made in Cremona, in the north of Italy, from the second half of the 17th century through the 18th century have been played by successive virtuosos and are still capturing the ears and hearts of modern people without fading away over more than 300 years. Specifically, violins made by Stradivari are called Stradivarius, and violins made by Guarneri are called Guarneri del Gesu. It is said that more exquisite instruments than the violins made by these two people would never, ever appear. Although Stradivari made about 2000 violins in his life, about 600 violins currently exist, and among them, about a hundred and several tens of violins are actually used in concerts. Then, how about the other four hundred and several tens of violins? They are exhibited in world-famous museums and memorial halls, kept in safes of public facilities, and owned as collections by the rich.

However, many instrumentalists reminisce that it took many years to tune violins that had been stored without being played at all for several hundred years, to sound as great as the original one. In view of this, nobody can say for certain that no problem would occur if exquisite instruments like Stradivarius and Guarneri del Gesu are stored only under controlled temperature and humidity.

Characteristic Structures of Violins

Many books about violins say "the violin is a musical instrument closest to the human voice" in common. The body of the violin is called a resonator and produces a unique resonance frequency through the f-hole in the front plate. With respect to full handmade violins, it is very difficult (impossible actually) to create exactly the same resonators. It means that, not only violins but also stringed instruments each have different characteristic sounds. The most unique structure of violins is a sound post, which is a pine pole of about 6 mm in diameter, between the front and back plates. The sound post has a function of amplifying vibrations of the front and back plates although it is not fixed using an adhesive agent. It is also known that a subtle difference in the location of the sound post totally differentiates sounds and vibrancy. The ideal location of the sound post in a violin is to be determined by the experiences of both a violin maker and an excellent violin player. Each component including a thin long strip called a bass bar, which is fitted to the back side of the front plate, and the front and back plates curved in arch shape does not have a complicated structure, but these components are so designed as to produce the best resonance, once assembled into a musical instrument like a violin.

Characteristics of Violins as Musical Instruments

A book, "Truth and Untruth of Stradivarius, SEKAI-BUNKA PUBLISHING INC." written by Muneyuki Nakazawa, a world renowned violin repair technician, says that "a violin composed of about 55 components is a creature made of materials most of which are organic," on pages 56 to 57. Not only violin makers feel violins as creatures, but also many instrumentalists who play exquisite instruments for the first time feel such admiration unanimously. That is, it is not too much to say that violins, which are said to be exquisite instruments, are able to fulfill their lives as creatures by being played by virtuosos. However, looking around the world, hundreds of exquisite violins are just stored under controlled temperature and humidity in dark cases like coffins, as if they are almost dead. Therefore, there are in fact many instrumentalists who recall that if such a violin is lucky to be given to a virtuoso tens or hundreds years later, it would take a considerable amount of time for the exquisite instrument to get back the same sounds as when it was made.

SUMMARY

To achieve the above objective, there is provided a vibration applying apparatus, including: a bone conduction speaker; a mounting unit on which a vibration target object is mounted; a vibration transmission unit configured to transmit a natural vibration emanating from the bone conduction speaker to the mounting unit; and a control unit configured to change a frequency of the natural vibration emanating from the bone conduction speaker, based on a result of determining whether an appropriate vibration is applied to the vibration target object, taking a natural vibration with which a stringed instrument resonates as a standard.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENT(S)

Hereinafter, a vibration applying apparatus according to one embodiment will be described in detail with reference to the accompanying drawings.

Embodiment

Figure 1:
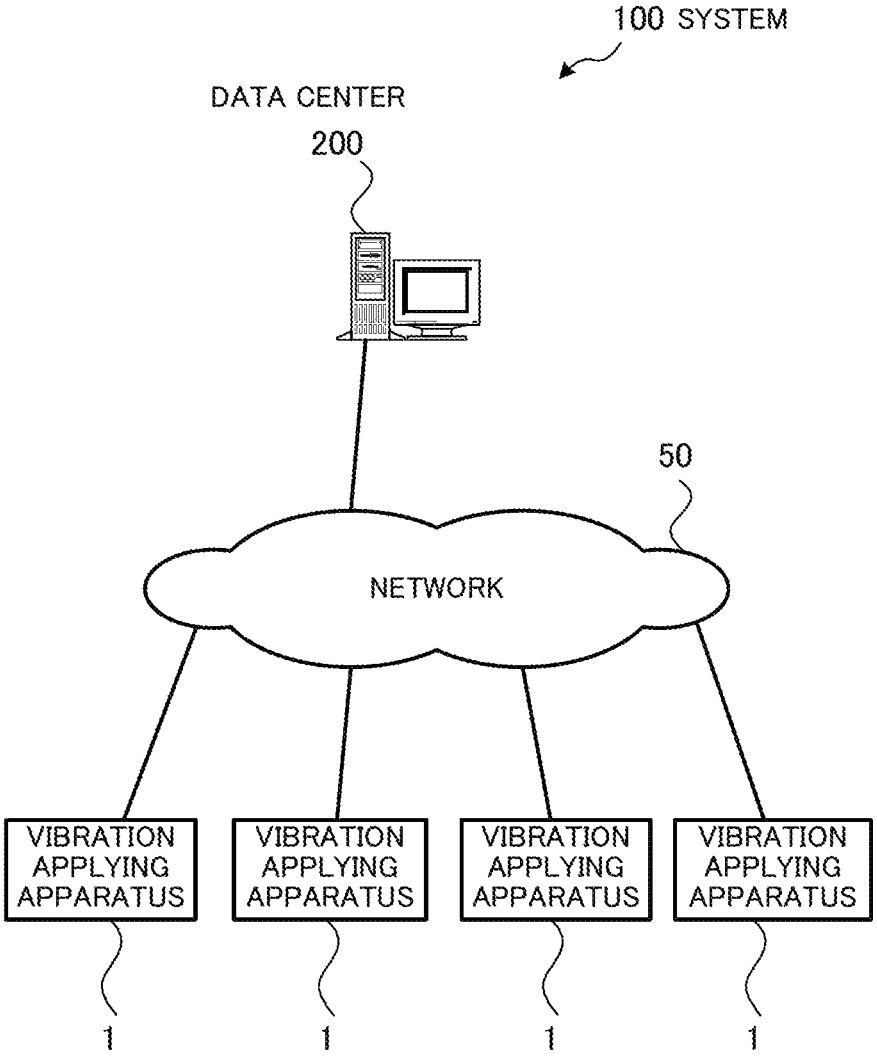
FIG. 1 is a view for explaining a system according to one embodiment.

FIG. 1 illustrates a system according to one embodiment.

In the system 100 of the embodiment, a plurality of vibration applying apparatuses 1 are connected to a data center 200 over a network 50. Each vibration applying apparatus 1 is given a unique identifier (ID) to allow the data center 200 to identify the vibration applying apparatuses 1.

Figure 2:
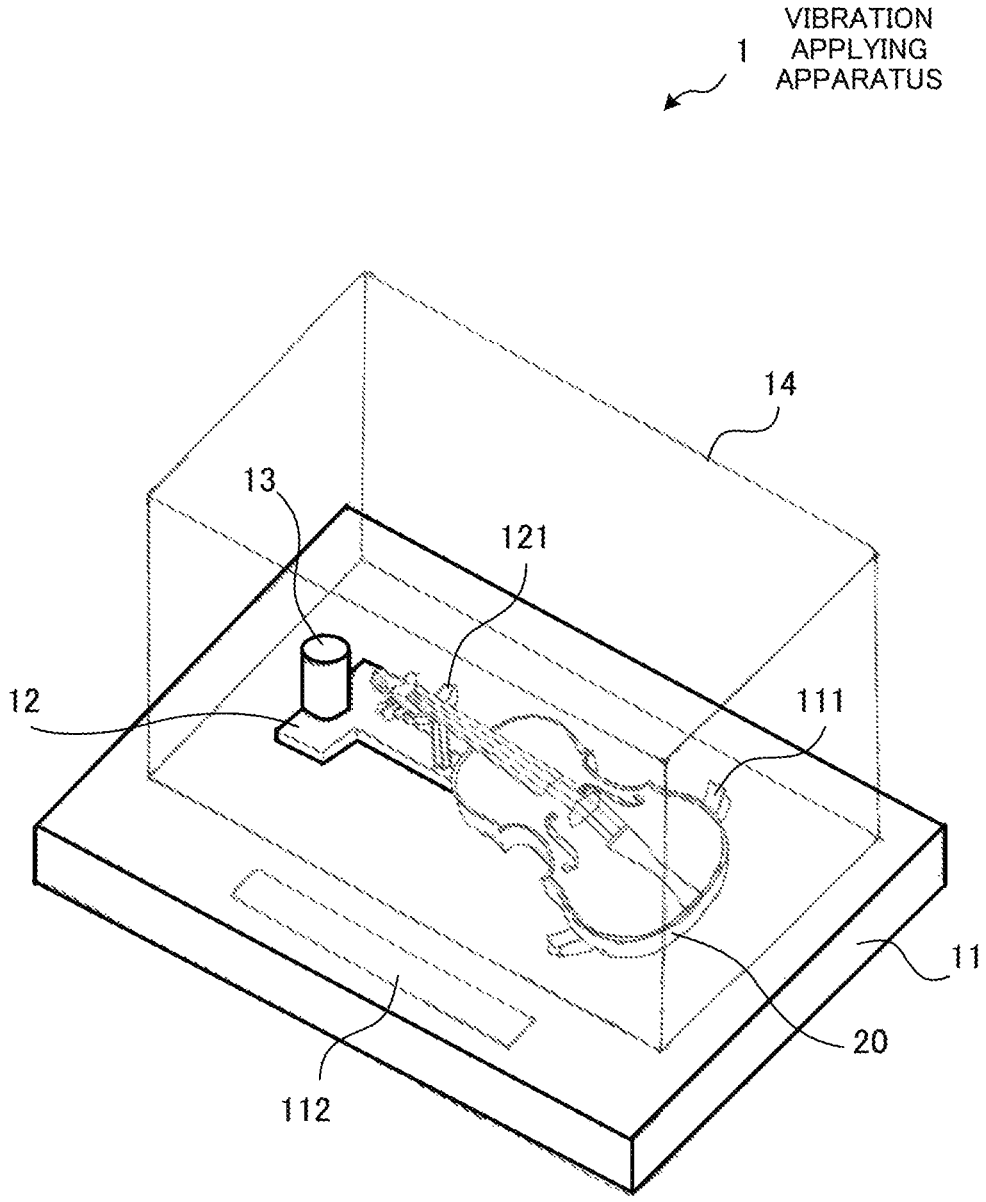
FIG. 2 illustrates a vibration applying apparatus according to the embodiment.

FIG. 2 is a view for explaining a vibration applying apparatus according to the embodiment.

The vibration applying apparatus 1 of the embodiment has a base 11.

A pedestal 12 made of wood is mounted on the upper surface of the base 11. A bone conduction speaker (bone conduction device) 13 is fixed to the pedestal 12. Referring to FIG. 1, the pedestal 12 is T-shaped, but its shape is not limited to the T-shape.

The bone conduction speaker 13 is able to play music that produces specific natural vibrations. The type of such music is not particularly limited, and examples of the music include musical compositions for orchestras with many stringed instruments, musical compositions for solo stringed instrument to be played by a virtuoso, and Solfeggio frequency (528 Hz or the like).

In addition, a supporting unit 121 for supporting the neck of a stringed instrument (vibration target object) 20 is mounted on the pedestal 12 in a vertical direction to the pedestal 12. A supporting unit 111 for supporting the back plate of the stringed instrument 20 is mounted on the base 11. FIG. 2 illustrates a violin as a stringed instrument. Note that the type of a stringed instrument is not particularly limited and other examples of such a stringed instrument include violas and cellos. In addition, in FIG. 2, the locations of the supporting unit 111 and the supporting unit 121 are fixed, but these units may be mounted so as to be movable in a long-side direction of the base 11, for example. By doing so, it becomes possible to stably support a stringed instrument according to its size and type.

In addition, the vibration applying apparatus 1 has a cover 14 that is placed on the base 11 for covering the bone conduction speaker 13 and stringed instrument 20. A groove may be formed where the base 11 and the cover 14 contact each other.

In the embodiment, the cover 14 is wholly made of glass. However, the shape of the cover 14 is not limited to the one illustrated.

Further, the materials of the base 11, pedestal 12, and cover 14 are not limited to those described earlier, and for example, resin or metal may be used.

Still further, a unit may partly be made of a different material. That is, for example, part of the cover 14 may be made of glass and the other part thereof may be made of wood or metal.

The pedestal 12, bone conduction speaker 13, and cover 14 form a main part of a resonance box that resonates the stringed instrument 20.

The base 11 has a display unit 112 and a control unit not illustrated.

The display unit 112 displays information (for example, the temperature and moisture inside the resonance box) about the vibration applying apparatus 1 in accordance with instructions from the control unit. In addition, the display unit 112 has a touch panel. A user is able to use the touch panel to send instructions to the control unit.

The control unit is able to control the type, volume, time, and others of music to be played through the bone conduction speaker 13 in accordance with user's instructions, for example.

In addition, although not illustrated, the vibration applying apparatus 1 may be provided with a mechanism to keep the temperature and moisture constant.

The following describes the hardware configuration of the vibration applying apparatuses 1 of the embodiment.

Figure 3:
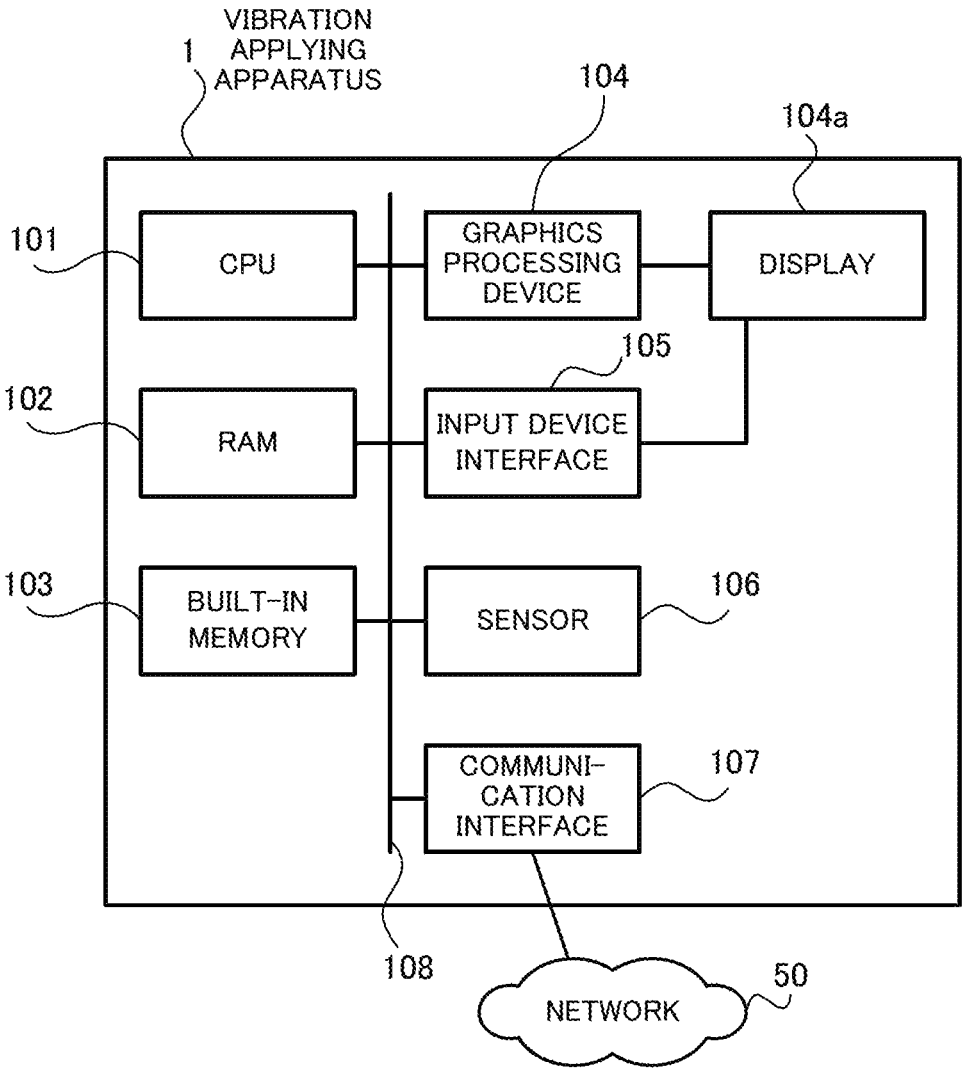
FIG. 3 illustrates a hardware configuration of the vibration applying apparatus according to the embodiment.

FIG. 3 illustrates a hardware configuration of the vibration applying apparatus according to the embodiment.

The vibration applying apparatus 1 is entirely controlled by a CPU (central processing unit) 101. A RAM (random access memory) 102 and a plurality of peripheral devices are connected to the CPU 101 via a bus 108.

The RAM 102 is used as a main storage device of the vibration applying apparatus 1. The RAM 102 temporarily stores therein at least part of application programs that are executed by the CPU 101. In addition, the RAM 102 stores therein various kinds of data to be used by the CPU 101 in processing.

Connected to the bus 108 are a built-in memory 103, a graphics processing device 104, an input device interface 105, a sensor 106, and a communication interface 107.

The built-in memory 103 magnetically writes and reads data. The built-in memory 103 is used as an auxiliary storage device of the vibration applying apparatus 1. The application programs and various kinds of data are stored in the built-in memory 103. A semiconductor storage device, such as a flash memory, may be used as the auxiliary storage device.

The graphics processing device 104 is connected to a display 104*a*. The display 104*a* corresponds to the display unit 112. The graphics processing device 104 displays images on a screen of the display 104*a* in accordance with instructions from the CPU 101. Examples of the display 104*a* include a liquid crystal display. In addition, the display 104*a* has a touch panel function.

The input device interface 105 gives signals received from the touch panel to the CPU 101.

The sensor 106 includes a sensor for detecting the eigenfrequency of the bone conduction speaker 13 and for detecting the resonance frequency of the stringed instrument 20. In addition, the sensor 106 includes a sensor for detecting the temperature and moisture inside the resonance box.

The communication interface 107 is connected to the network 50. The communication interface 107 communicates data with the data center or another communication device over the network 50.

With the above hardware configuration, the processing functions of the present embodiment may be implemented.

The following describes an example of how the vibration applying apparatus 1 operates.

First, the user takes the cover 14 off the base 11 and places the stringed instrument 20 on the supporting unit 111 and supporting unit 121. Then, the user places the cover 14 on the base 11 to complete a resonance box, which is kept airtight inside. In addition, the user operates the touch panel of the display unit 112 to specify the type of the stringed instrument placed in the resonance box. The user also specifies the type of music to be played through the bone conduction speaker 13.

The control unit causes the bone conduction speaker 13 to play music that produces natural vibrations, and to transmit the natural vibrations with which the stringed instrument 20 resonates, via the pedestal 12 and supporting unit 121. By doing so, it is possible to create a state as if the stringed instrument 20 is actually played.

Each vibration applying apparatus 1 sends data including the waveform of natural vibrations detected by the sensor 106 to the data center 200 over the network 50. In this connection, the following two waveforms are considered as data to be sent from the vibration applying apparatus 1 to the data center 200.

Pattern 1: A combination of the waveform of natural vibrations of the bone conduction speaker 13, the type of the stringed instrument 20 placed in the resonance box, and a unique ID.

Pattern 2: A combination of the waveform of natural vibrations produced from the resonance of the stringed instrument 20 placed in the resonance box, and the unique ID.

The data center 200 checks these waveforms received from the vibration applying apparatus 1 to determine whether appropriate vibrations are applied to the stringed instrument.

More specifically, the data center 200 compares the waveform of natural vibrations against a prescribed standard, and determines, if the standard is satisfied, that the vibrations applied are appropriate. For example, if the eigenfrequency produced by the sound post of the stringed instrument 20 is close to 528 Hz, the data center 200 determines that the vibrations applied are appropriate.

If the standard is not satisfied, the data center 200 determines that the vibrations applied to the stringed instrument 20 by the bone conduction speaker 13 are not appropriate, and then sends an instruction for improving the vibrations to the vibration applying apparatus 1 over the network 50. At this time, the data center 200 may send a signal for displaying a warning screen on the display unit 112. Alternatively, the data center 200 may send a signal for instructing a change of the vibration frequency to the control unit. The control unit that has received the instruction for improving the vibrations from the data center 200 may change the frequency of the natural vibrations to be applied to the stringed instrument 200 by the bone conduction speaker 13, and then the vibration applying application 1 sends data including the waveform of the natural vibrations detected by the sensor 106 to the data center 200 over the network 50 again. This operation is repeated until the data center 200 determines that the vibrations applied are appropriate. By doing so, it is possible to apply appropriate vibrations to the stringed instrument 20.

In addition, the data center 200 is able to manage the time to apply vibrations to the stringed instrument, determine whether the stringed instrument is able to provide a sufficient performance, and send the determination result to the vibration applying apparatus 1. For example, in the case where the time to apply vibrations to the stringed instrument is longer than a prescribed period of time, the data center 200 determines that the stringed instrument is in a state of providing a sufficient performance, and sends this determination result to the vibration applying apparatus 1.

As described above, the vibration applying apparatus 1 has the bone conduction speaker 13, the pedestal 12 to which the bone conduction speaker 13 is fixed, and the supporting units 112 and 121 on which the stringed instrument 20 is placed, and is designed to transmit natural vibrations emanating from the bone conduction speaker 13 to the supporting unit 121 via the pedestal 12.

If a stringed instrument is managed and stored under controlled temperature and moisture but is not played over a long time, the stringed instrument is not possibly able to exhibit its performance sufficiently.

It is expected that, by keeping on applying vibrations from the vibration applying apparatus 1 via the bone conduction speaker 13 to a stringed instrument, the stringed instrument becomes in a state of operating stably because of the so-called aging effect. That is, it can be expected that, by stably applying, for a prescribed period of time, vibrations from the vibration applying apparatus 1 to a stringed instrument that has not been played over a long time, the stringed instrument becomes able to exhibit its performance as if the stringed instrument has periodically been played by an instrumentalist.

In addition, it is possible to greatly reduce the risk of losing the characteristic sounds of a stringed instrument by measuring the effects of natural vibrations to be applied to the stringed instrument using the artificial intelligence-based management system.

In this connection, in the embodiment, the vibration applying apparatus 1 is formed in a box shape. However, the shape of the vibration applying apparatus is not limited thereto and, for example, the vibration applying apparatus may be formed in a shape like a case with handles for carriage.

In addition, the embodiment has described the example of using the vibration applying apparatus 1 for enabling the stringed instrument 20 to exhibit its performance. However, the vibration applying apparatus 1 is not limited thereto and, for example, may be used to adjust the location of a sound post or detect troubles in the stringed instrument 20, using vibrations that emanate from the bone conduction speaker 13.

Further, the embodiment has exemplified a stringed instrument as a vibration target object. However, the vibration target object is not limited thereto and may be cut materials for a stringed instrument. Examples of such materials for a stringed instrument include spruce and maple. These materials are placed in the resonance box and are supplied with natural vibrations through the bone conduction speaker 13 over a long period of time. Then, a stringed instrument is made using these materials. By doing so, it is expected that an effect like prenatal education for unborn baby may be given to the stringed instrument.

In this connection, the vibration applying apparatus 1 may be designed to have some of the functions of the data center 200, or the data center 200 may be designed to have some of the functions of the vibration applying apparatus 1.

Heretofore, the vibration applying apparatus of the present embodiment has been described as the embodiment illustrated. The embodiment is not limited thereto, and the components of each unit may be replaced with other components having equivalent functions. In addition, other desired configurations and steps may be added to the embodiment.

Further, two or more desired configurations (features) described in the above-described embodiment may be combined.

The above-described processing functions may be implemented by using a computer. In this case, a program is prepared, which describes processes for the functions of the vibration applying apparatus 1. A computer implements the above-described processing functions by executing the program. The program describing the intended processes may be recorded on a computer-readable recording medium. Computer-readable recording media include magnetic storage devices, optical discs, magneto-optical recording media, semiconductor memories, etc. The magnetic storage devices include HDDs, flexible disks (FD), magnetic tapes, etc. The optical discs include DVDs, DVD-RAMs, CD-ROMs, CD-RWs, etc. The magneto-optical recording media include MOs (magneto-optical disks), etc.

To distribute the program, portable recording media, such as DVDs and CD-ROMs, on which the program is recorded, may be put on sale. Alternatively, the program may be stored in the storage device of a server computer and may be transferred from the server computer to other computers over a network.

A computer which is to execute the above program stores in its local storage device the program recorded on a portable recording medium or transferred from the server computer, for example. Then, the computer reads the program from the local storage device, and runs the program. The computer may run the program directly from the portable recording medium. Also, while receiving the program being transferred from the server computer, the computer may sequentially run this program.

In addition, the above-described processing functions may also be implemented wholly or partly by using DSP (digital signal processor), ASIC (application-specific integrated circuit), PLD (programmable logic device), or other electronic circuits.

According to one aspect, it is possible to minimize the performance degradation of a vibration target object.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

What is claimed is:

1. A vibration applying apparatus, comprising:

a bone conduction speaker;

a mounting unit on which a vibration target object is mounted;

a vibration transmission unit configured to transmit a natural vibration emanating from the bone conduction speaker to the mounting unit; and a control unit configured to change a frequency of the natural vibration emanating from the bone conduction speaker, based on a result of determining whether an appropriate vibration is applied to the vibration target object, taking a natural vibration with which a stringed instrument resonates as a standard.

2. The vibration applying apparatus according to claim 1, further comprising an airtight unit that covers the vibration target object placed on the mounting unit and that is kept airtight inside.

3. The vibration applying apparatus according to claim 1, further comprising handles for carriage.

4. The vibration applying apparatus according to claim 1, wherein the vibration target object is a stringed instrument or wood that is a material for the stringed instrument.

* * * * *